US005267923A

United States Patent [19]

Piaget et al.

[11] Patent Number: 5,267,923

[45] Date of Patent: Dec. 7, 1993

[54] RECIPROCATING BELLOWS OPERATED EXERCISE MACHINE

[76] Inventors: Gary Piaget, 1435 W. Silvermeadows Dr.; Trace Gordon, 3880 W. Tariat Rd., both of Park City, Utah 84060

[21] Appl. No.: 6,668

[22] Filed: Jan. 19, 1993

Related U.S. Application Data

[63] Continuation of Ser. No. 735,258, Jul. 24, 1991, abandoned.

[51] Int. Cl.[5] ..... A63B 22/09

[52] U.S. Cl. ..... 482/53; 482/52; 482/80

[58] Field of Search ..... 482/79, 80, 52, 53, 482/58, 59, 133; 128/25 R, 25 B

[56] References Cited

U.S. PATENT DOCUMENTS

| | | | |
|---|---|---|---|
| 2,206,902 | 7/1940 | Kost | 482/79 |
| 3,821,951 | 7/1974 | Giles | 482/80 |
| 3,917,262 | 11/1975 | Salkeld | 272/134 |
| 4,204,675 | 5/1980 | McGinnis . | |
| 4,279,415 | 7/1981 | Katz . | |
| 4,405,129 | 9/1983 | Stuckey . | |
| 4,635,931 | 1/1987 | Brannstam . | |
| 4,673,180 | 6/1987 | Rice | 482/147 |
| 4,676,501 | 6/1987 | Hoagland et al. | 272/134 |
| 4,787,630 | 11/1988 | Watson et al. | 482/146 |
| 4,989,858 | 2/1991 | Young et al. | 272/70 |

FOREIGN PATENT DOCUMENTS

| | | | |
|---|---|---|---|
| 2031742 | 4/1980 | Spain | 272/70 |

*Primary Examiner*—Richard J. Apley
*Assistant Examiner*—Lynne A. Reichard
*Attorney, Agent, or Firm*—Salter, Michaelson & Benson

[57] ABSTRACT

Foot treadle operated exercising apparatus of this invention provides for transfer of air from one foot treadle operated vertically disposed bellows to another through a restricted pathway adjustable in size by an adjustable valve to select a desired work load. A stroke length adjustment is featured for changing the length of the stroke. This is achieved with bellows that are biassed to return to an extended condition in the presence of atmospheric air. Thus with a closed air system, a manually operated air admission and venting valve will increase the bellows height when opened to admit atmospheric air and will decrease the bellows height when opened and pedals are depressed to vent air. The foot treadles are operable from a standing, sitting or lying position. An auxiliary arm exercise harness operates in conjunction with the foot operated treadles by means of hand manipulated lines cross connected so that the left hand will depress a right foot treadle and visa versa. The entire work load is effected by the transfer of air from one bellows to the other when the treadles are operated in a riding, jogging or climbing action. One embodiment provides for bicycle riding type of exercise activity.

14 Claims, 3 Drawing Sheets

RECIPROCATING BELLOWS OPERATED EXERCISE MACHINE

This is a continuation of application Ser. No. 07/735,258 filed Jul. 24, 1991 now abandoned.

TECHNICAL FIELD

This invention relates to exercise machines and more particularly to in-place foot treadle riding, climbing or jogging machines which compress air entrapped in an enclosure.

BACKGROUND ART

In-place jogging and climbing devices are known in the exercising arts, such as in U.S. Pat. No. 4,279,415, S. Katz, Jul. 21, 1981 for Exercising Device. Thus, two independent side-by-side coil spring biased treadles are manipulated in a jogging or climbing action by coordination of the feet of the user to compress both work absorbing springs and surrounding plastic foam. The foam and springs, however, are limited in height and length of operation and do not produce a consistent work load throughout a work stroke, so that realistic and comfortable foot action is afforded. Furthermore, pivoted, slanted treadles require ankle bending and makes the most force bear upon the toes so that the body action is not ideal, particularly for jogging motion.

A variation of this device is shown in U.S. Pat. No. 4,204,675, G. McGinnis, May 27, 1980 for Air Chamber Leg Exercising Device, which uses both compressible "breathing" elastic air chamber bags and spring loaded treadles for establishing a work load, in which the exit resistance of exhausted air from the bags is controlled by a manually operable spring bias loading for an exhaust valve to establish a partly variable work load. The treadle is connected to the air bag wall to force it to suck in air from a flap valve as it is raised. Treadle hinge springs, valves and bags are critical in control and subject to overload by exerciser's weight, etc. and have limited reliability and life. Furthermore, the breathing controls take a finite time to operate in filling the bags for a power stroke, and thus limit the speeds and interfere with natural rhythm in exercising.

Bellows type air compression chambers are disclosed in U.S. Pat. No. 4,635,931, G. Brannstam, Jan. 13, 1987 for Apparatus for Arm and Leg Exercise. This device is used by persons lying in a bed. The air in the bellows is forced in and out by exercise. Air intake and exhaust valves require the foot to be attached to the bellows, which in turn is attached to the bed, and adjustable valves resist the intake and exhaust of air to regulate the respective work loads of pushing and pulling. This operating principle is not adaptable to jogging or climbing exercise where the exercising force for each leg is provided on a downward compression stroke only.

A bladder type bag eliminates treadles in U.S. Pat. No. 4,405,129, J. Stuckey, Sep. 20, 1983 for Therapeutic Exercise Device. The bladder can be blown up to a desired pressure above atmospheric, and foot (or other body part) pressure upon two bladder compartments transfers air reciprocally from one to the other over a restricted passageway that determines in part the work load, as modified by the pressure within the bladder. This bladder construction provides a very limited work stroke length, and does not provide a sense of balance that comes with a rigid treadle platform.

One primary deficiency in the art is the inability to provide long enough stroke distances for requiring leg action and bending of the knees in jogging and climbing exercises, and stroke adjustments for adaption to various user's preferences or for simulating the distance between stair steps.

Another criticism of the prior art exercising devices is the dependency upon springs. Not only are springs costly, but they have limited life, are subject to change and stress during the course of use, are not adaptable to long or variable strokes, and afford a very limited range of work load variation.

Exercise devices should also provide an optional versatility of body building exercises. The prior art jogging-climbing devices of simple and inexpensive construction, for example, do not afford arm and shoulder exercise, as might be afforded when jogging by means of swinging weights synchronously with foot action. Further, exercising from standing, sitting and lying positions is rarely feasible in prior art devices of the class herein proposed.

The treadle operated exerciser devices of the prior art also have not been comfortable in operation to give a sense of balance when riding, walking, climbing or jogging in place on the treadles. Prior art construction of the treadles, particularly with slanted and spring biased treadle structure, tends to fatigue or over exercise ankle joints.

Thus it is a primary objective of this invention to provide improved exercising apparatus that overcomes the aforesaid prior art deficiencies. Objectives include the provision of inexpensive, reliable and versatile exercising devices for in-place riding, jogging or stair climbing exercises. Other objects, features and advantages of the invention will be found throughout the following description, claims and accompanying drawings.

DISCLOSURE OF THE INVENTION

The versatile exercising device afforded by this invention provides riding exercises simulating bicycle riding, vertical climbing exercises providing an aerobic workout equivalent to climbing stairs, and jogging exercises without skeletal trauma by use of compressible air as a working medium. Treadle, or pedal operated bellows for each foot are coupled to an air enclosure system that transfers air from one bellows to the other, thereby reciprocating the treadles in response to the forces on the pedals from the user.

To control the work effort of the user in riding, jogging or climbing stairs on the treadles, a manually operated valve controls the resistance or work effort for transferring the air from one bellow to the other. A stair height control is provided in the form of a manually operable air venting and admission valve. Thus, to decrease stair step heights, the air vent valve is opened and the treadles are depressed to the desired height. To increase stair step heights, the air vent becomes an air admission valve manually opened to permit the bellows to automatically extend the height to a maximum adjustment while admitting more air into the normally closed air enclosure.

Further operational features include (1) the orientation of the exerciser unit for operation in standing, sitting or lying positions, (2) treadle design and unit construction for providing optional operating positions for lower and higher operating energy, (3) harnesses for permitting simultaneous arm and leg workout by means of hand grasps on lines so that the right arm can help depress the left leg bellows and vice versa, and (4) bicycle simulation for riding exercise.

Other objects, features and advantages of the invention will be found throughout the following description and in the accompanying drawings and claims.

BRIEF DESCRIPTION OF THE DRAWINGS

In the accompanying drawings, wherein like reference characters relate to similar features to facilitate comparison.

THE PREFERRED EMBODIMENTS

Figure 1:
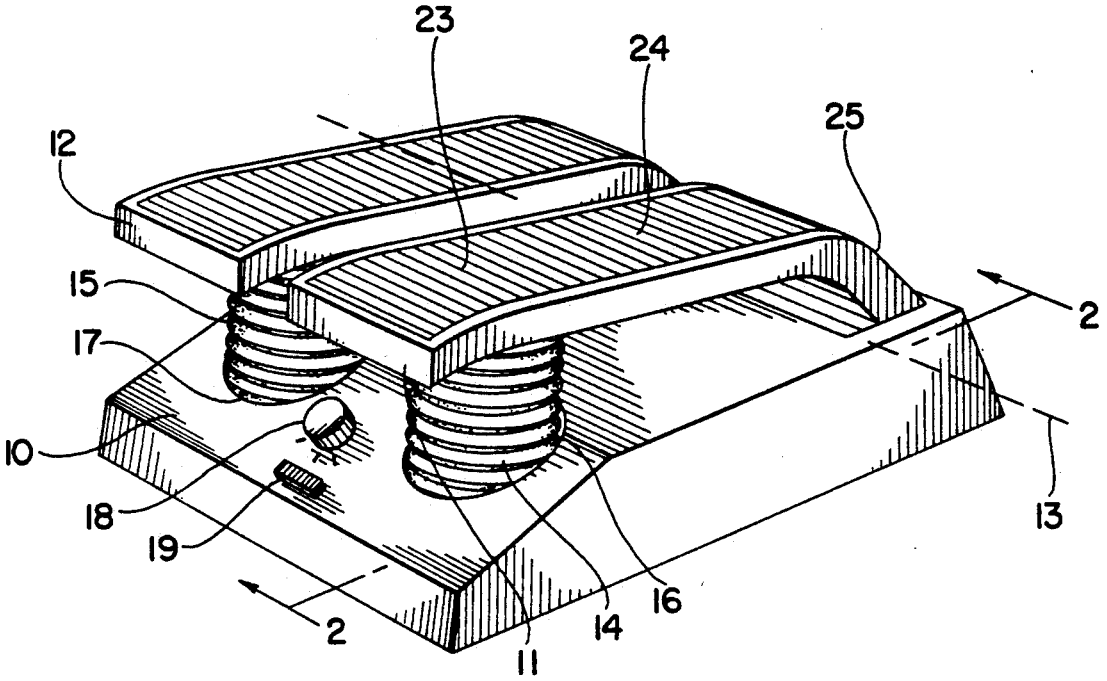
FIG. 1 is a perspective sketch of a treadle operated exercise unit afforded by the invention.

The self contained exercise unit afforded by this invention resides in the base or housing 10. A pair of foot treadles 11, 12 are mounted for pivoting about pivot axis 13, to respectively compress the normally extended bellows 14, 15, residing in wells 16, 17 in the housing, so that the housing limits the treadle stroke at the the bottom of the stroke. The manually controlled push type air vent and admission valve 18 controls the height or upper limit of the treadle stroke. The rotatable valve 19 controls the resistance of air transfer from one bellows 14 to the other 15 thereby establishing a range of work efforts between lower and higher limits.

Figure 2:
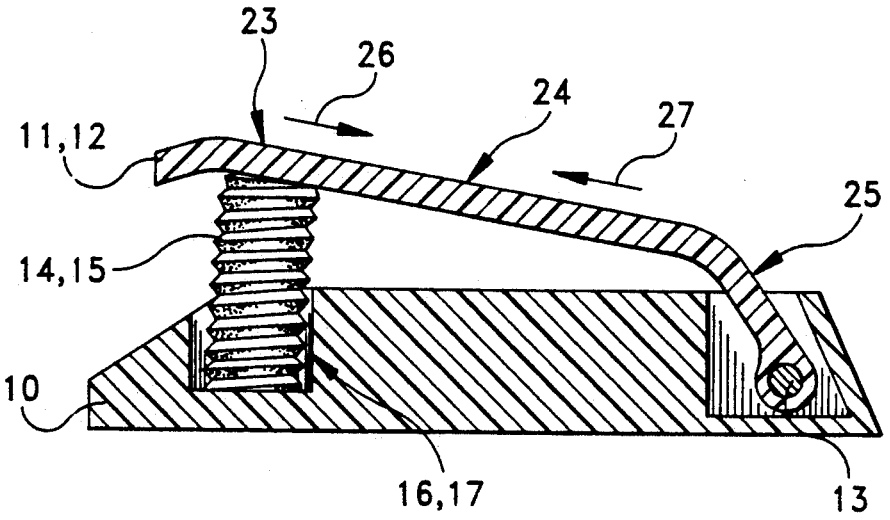
FIG. 2 is a side view sketch illustrating the treadle and bellows.

As may be seen also by reference to FIG. 2, the treadles provide two working platforms 23, 24 for the feet of the user. It may be seen that platform 23 is aligned with the vertical axis of the bellows 14, 15 so that the users weight on that platform position directly retracts the bellows. As indicated by arrow 26, the toes are pointed towards the treadle mount axis 13 when using platform 23. This provides a lighter range of exercise.

When using platform 24, the toes are pointed, as indicated by arrow 27, in a direction away from the treadle mount axis 13. This footrest platform is intermediate the generally concavely oriented treadle extensions, namely: platform 23 at one end of the treadle and the angular pivotable member 25 that determines the slant from horizontal of the intermediate platform 24. Thus, the second class lever arrangement provides for only a portion of the body weight to be spent upon the work that retracts bellows 14, 15. Thus a heavier range of exercising is provided by the use of platform 24. The proportion of work effort used to compress (retract) bellows 14, 15 with use of the intermediate platform 24 can be established by design of the angle of and length of the angular pivotable end member 25 for movement about the pivot axis 13.

Figure 3:
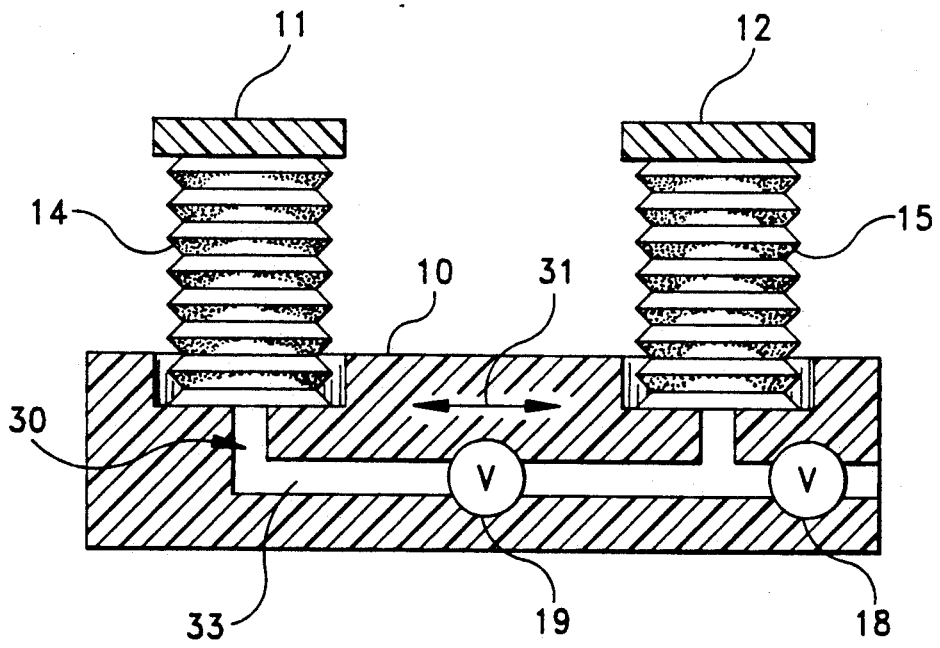
FIG. 3 is a schematic sketch of the operating system o the invention.

The operation of the exercising device is clarified by the schematic working diagram of FIG. 3. The bellows 14, 15 are preferably cylindrical in shape of an elastic biased plastic material such as PVC, such as sections from commonly available flexible drain pipes of about four inches (10 cm) in diameter. The inherent elasticity of the material is thus biased to extend rather than to retract s that the fully extended height is normally attained in the presence of atmospheric air pressure. Thus, when the (normally closed) vent valve 18 is opened the treadles 11, 12 are pushed upwardly automatically. To adjust the stair height, therefore, one treadle 11, 12 is forcefully depressed with vent valve 18 open to establish the desired tread height between the retracted condition of the bellows forced downwardly with respect to the expanded position of the other bellows. Then the bellows pair will reciprocate under forces imparted by the user as controlled by the restrictive flow adjustable valve 19, which is manually set for a range of exercise effort to control the reciprocal flow of air within the closed air compartment 30 as indicated by arrow 31. The vent valve may also act as a safety valve to vent air upon overload of the closed air compartment 30. Thus, the height of the stair steps is inversely a function of the volume of air in the closed compartment 30.

The bellows 14, 15 are preferably sealed to or otherwise attached to the treadles 11, 12 at the upper end of the air chamber 30 and to the piping 33 at the lower end, typically a flexible hose adapted to handle the maximum pressure expected from the compression of the bellows with the full weight of the users body on the platform 23.

Figure 4:
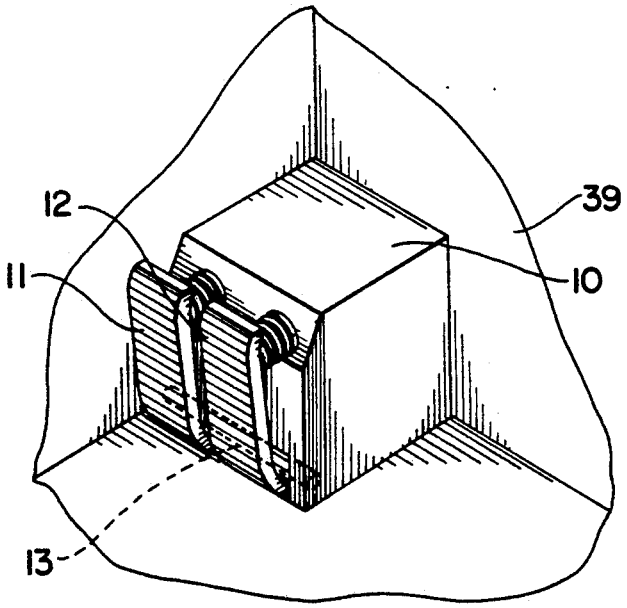
FIG. 4 is a perspective sketch illustrating the operation of the exercise unit in different positions.

As seen in FIG. 4, the housing 10' can be made so that it stands adjacent a wall 39, or some equivalent support surface, to permit the user to operate the exercise device while lying down. The housing 10' can be turned upside down for putting the feet at the proper position for lighter or heavier work loads with the dual platform feature hereinbefore described. The housing can be adapted to hang on the wall, at chest height, to exercise the upper body and arms.

Figure 5:
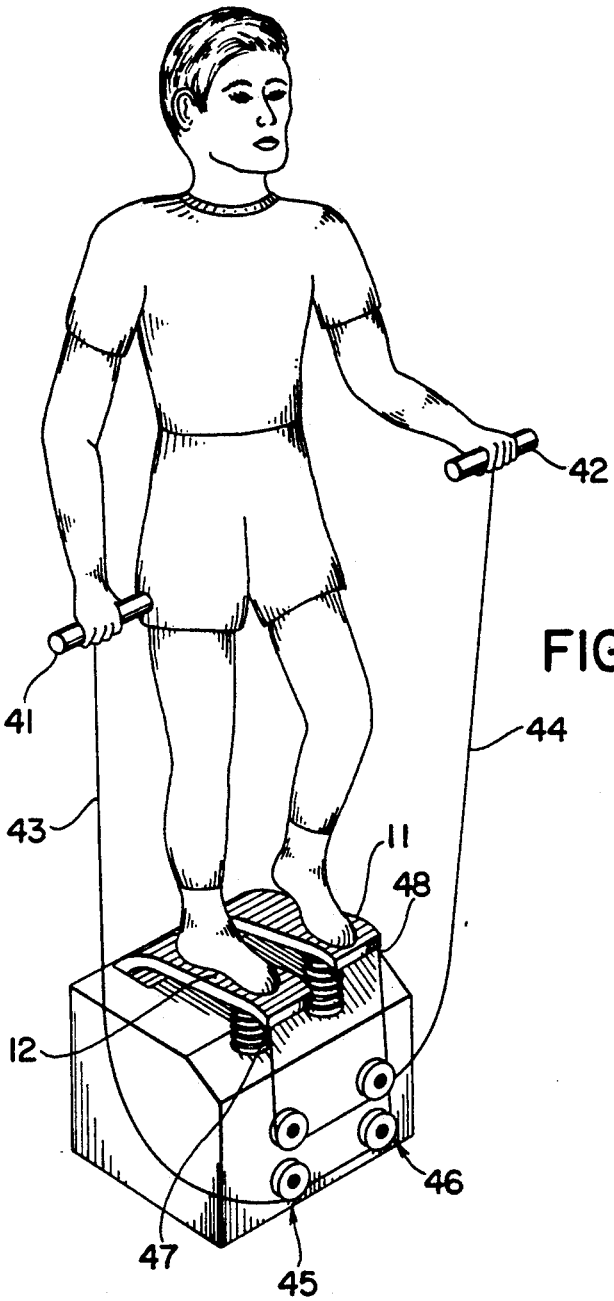
FIG. 5 is a perspective sketch showing a harness for simultaneous arm and leg exercise with the exercise unit afforded by this invention.

An embodiment for joint exercise of arms and legs is shown in FIG. 5. A harness arrangement provides hand grips 41, 42 and lines 43, 44 arranged about pulley sets 45, 46 and attached to the underside of the treadles 11, 12 at 47, 48 so that the arms can help pull the treadles downwardly. In this preferred embodiment, which provides rhythm between arm and leg movements, the right hand line is cross connected with the left hand treadle and vice versa.

Figure 6:
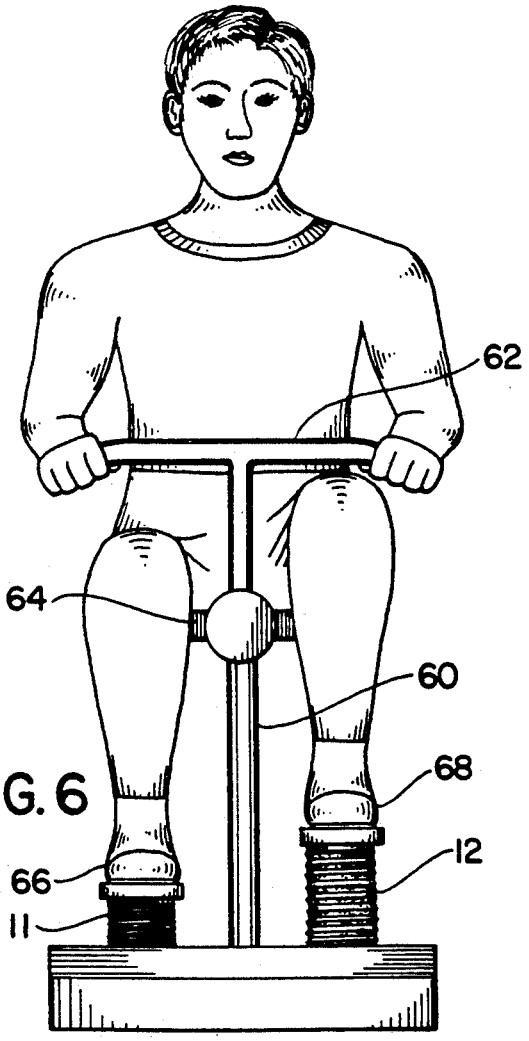
FIG. 6 is a sketch showing an exercise unit embodiment with a simulated bicycle frame for sit down exercising.

This invention is particularly adapted to bicycle riding simulation as evidenced by FIG. 6. Thus a bicycle post 60 terminating in handlebars 62 and having a saddle 64 permits the "rider" to operate pedals 11, 12 in a bicycle riding style. The toe straps 66, 68 optionally provided permit the legs to assist pulling the pedals upward.

It is therefore seen that this invention has advanced the state of the art, and therefore those novel features setting forth the spirit and nature of the invention are set forth with particularity in the following claims.

We claim:

1. Exercise apparatus comprising in combination a housing, a pair of bellows of a plastic material located in said housing and having a configuration that elastically extends the bellows into an elongated position, each of said bellows having an elongated axis that is located in spaced, parallel relation with respect to the longitudinal axis of the other bellows, each of said bellows being compressed along the longitudinal axis thereof, an airtight sealed system in said housing including means interconnecting the bellows for transfer of air from one bellows in the pair to the other, atmosphere control means for admitting atmospheric air into the sealed system and venting air from the sealed system to the atmosphere manually controlled by an air admission and vent valve, a pair of pedals mounted on said housing, each of said pedals being mounted for individual forceful actuation by force of a user's foot in a compression direction for the air in said sealed system thereby to transfer said air from one bellows to the other of said pair, valve means for restricting the passage of air from said compression from one bellows to the other, and means for pivoting said pedals on said housing for movement about a pivot axis as a function of the movement of said pair of bellows, the pivot axis of said pedals extending in a direction substantially horizontal and being disposed in spaced relation with respect to said bellows, the longitudinal axis of each of said bellows being substantially normal to the plane of the pedal in engagement therewith.

2. Exercise apparatus comprising a housing, a first bellows member having a longitudinally extending axis and being mounted in said housing for compressive and expandable movement substantially along the longitudinal axis thereof, a second bellows member having a longitudinally extending axis and being mounted in said housing adjacent to said first bellows member for compressive and expandable movement substantially along the longitudinal axis thereof, the longitudinally extending axes of said bellows members being disposed in spaced, parallel relation, a closed fluid system located in said housing and interconnecting the interiors of said bellows members, said closed fluid system being operable for maintaining a predetermined amount of fluid in the interior of said bellows members, means in said fluid system for controlling the flow of fluid to and from said bellows members upon compressive and expandable movement thereof, wherein said fluid provides for controlled resistance in said bellows members during a compressive movement thereof, a pair of pedal members for receiving thereon the feet of a user of said apparatus during an exercise routine, each of said pedal members having a lower portion that is pivotally mounted on said housing, a portion of the other end of each pedal member overlying an uppermost end of a bellows member and being located in engagement therewith, the pivot connections of said bellows members being located in coaxial relation along an horizontal axis in said housing, the horizontal axis of said pivot connections being located substantially vertically lower than the uppermost ends of said bellows members and the portions of said pedal members that are located in engagement with said bellows members, said horizontal axis of said pedal members being located in rearwardly spaced relation with respect to the longitudinal axis of each bellows member, said bellows members being alternately compressed and expanded along the longitudinal axes thereof as said fluid is transferred thereto and forced therefrom upon exertion by said user of a forceful pressure of the feet of the user on said bellows members in alternating relation during said exercising routine, said portion of the other end of each pedal member being maintained in positive engagement with the uppermost end of a bellows member as it is moved downwardly in a compressive movement to maintain a constant force on the bellows member with which it is engaged.

3. An exercise apparatus as claimed in claim 2, each of said pedal members including the portion that overlies the uppermost end of a bellows member, and that further includes the lower portion that is pivotally mounted on said housing, the configuration of said pedal members enabling a user to either face upwardly on said pedal members with the user's heels in engagement with the portions of said pedal members that are adjacent to the pivot axes of said bellows or to face downwardly on said pedal members with the user's heels in engagement with the portions of said pedal members that overlie said bellows.

4. Exercise apparatus as claimed in claim 2, harness means interconnected to said bellows members and being operable by the hands of said user for coordinating with the compressive movement of said pedal exerted by the feet of the user to provide an additional exercise movement for the user.

5. An exercising apparatus as claimed in claim 4, said pedal members including a right and left pedal member, said harness means including right and left cord members, each of which is secured to a pedal member, pulleys mounted on said housing for receiving said cord members thereon, wherein the right hand of the user exerts a pulling action on the right cord member that is connected to the left pedal member and the left hand of the user exerts a pulling action on the left cord member that is connected to the right pedal member.

6. Exercise apparatus as claimed in claim 2, a simulated bicycle frame having a seat and handlebars mounted thereon, said housing located beneath said frame, wherein said foot pedals are positioned for engagement by the feet of a user who is located on said seat.

7. Exercise apparatus as claimed in claim 2, valve means located in said fluid system between said bellows members for controlling the amount of fluid transfer to and from said bellows members wherein the resistance of movement of said bellows members is controlled.

8. Exercise apparatus as claimed in claim 7, a second valve means located in said fluid system for initially controlling the admission of fluid into one of said bellows embers for establishing the length of movement of said bellows members during the compressive strokes thereof, said second valve means further functioning as a relief valve for the fluid system.

9. Exercise apparatus for use by a user in an exercise routine comprising a pair of cylindrical bellows each of which has a longitudinally extending axis, each of said bellows being operable to compress and expand in direction along the longitudinally extending axis thereof, a fluid system communicating with the interior of said bellows and providing a biasing force for alternately urging one of said bellows into a compressing position while simultaneously expanding the other bellows when the foot of a user exerts a compressive force on said one bellows, a pivotal treadle overlying each of said bellows and being responsive to the alternating force exerted by the feet of the user for axially moving said cylindrical bellows into the alternate compressive and expansion positions, the pivot axis of said treadles being located in spaced relation from the longitudinal axes of said bellows and being located substantially below the uppermost ends of said bellows.

10. Exercise apparatus as claimed in claim 9, said fluid system including atmospheric air as the biasing medium.

11. Exercise apparatus as claimed in claim 10, said bellows being formed of a retractable plastic material that provides for the movement of said bellows to the expanded position thereof upon introduction of said air therein.

12. Exercise apparatus for use in an exercise routine, comprising a housing, a pair of work absorbing members mounted in said housing and being responsive to a force exerted thereon for alternately moving to and from a compressive and expanded position, a pair of pivotal foot treadles that are mounted on said housing for engagement with said work absorbing members, said treadles each being formed in a configuration that includes a first platform portion that directly overlies and engages a work absorbing member, a lower end portion remote from said first platform portion and being pivotally mounted along a horizontal axis on said housing, wherein said pivot axis is disposed substantially vertically lower than said horizontal first platform, and a second platform portion located intermediate said first platform portion and said lower end portion, wherein a force exerted on said first and second platform portions by the user of said apparatus produces a corresponding compressive force on said work absorbing member.

13. Exercise apparatus as claimed in claim 12, each of said work absorbing members being compressible in a downwardly direction, wherein a downwardly directed force exerted on a treadle by the foot of a user of said apparatus during the exercise routine causes each work absorbing member to be compressed.

14. Exercise apparatus as claimed in claim 13, means for introducing a fluid medium into said work absorbing members, said fluid medium being alternately transferred from one work absorbing member to the other as a force is exerted thereon through said treadles, said fluid medium providing for a controlled resistance to the compressed force exerted on said work absorbing members.

* * * * *